US009938871B2

(12) United States Patent
Koch

(10) Patent No.: US 9,938,871 B2
(45) Date of Patent: Apr. 10, 2018

(54) CONNECTION PIPE FOR CONNECTING AN ACTIVE MUFFLER TO AN EXHAUST SYSTEM FOR AN INTERNAL COMBUSTION ENGINE

(71) Applicant: Eberspächer Exhaust Technology GmbH & Co. KG, Neunkirchen (DE)

(72) Inventor: Viktor Koch, Plochingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 15/260,683

(22) Filed: Sep. 9, 2016

(65) Prior Publication Data

US 2017/0074134 A1 Mar. 16, 2017

(30) Foreign Application Priority Data

Sep. 11, 2015 (DE) ..... 10 2015 217 461

(51) Int. Cl.

| | |
|---|---|
| ***F01N 1/00*** | (2006.01) |
| ***F01N 3/02*** | (2006.01) |
| ***F01N 1/06*** | (2006.01) |
| ***F01N 13/00*** | (2010.01) |
| ***G10K 11/16*** | (2006.01) |

(52) U.S. Cl.

CPC ..... *F01N 1/065* (2013.01); *F01N 1/00* (2013.01); *F01N 3/0205* (2013.01); *F01N 13/007* (2013.01); *G10K 11/161* (2013.01); *F01N 2240/02* (2013.01); *F01N 2260/02* (2013.01); *F01N 2260/022* (2013.01); *F01N 2260/20* (2013.01); *F01N 2470/00* (2013.01)

(58) Field of Classification Search

CPC ..... F01N 2260/02; F01N 2260/022; F01N 2260/024; F01N 3/0205

USPC ..... 181/283

See application file for complete search history.

(56) References Cited

U.S. PATENT DOCUMENTS 6,347,511 B1 * 2/2002 Haines ..... B01D 53/9431 422/169
8,596,050 B2 * 12/2013 Gerlach ..... F01N 5/02 165/135

(Continued)

FOREIGN PATENT DOCUMENTS

| | | |
|---|---|---|
| CH | 616 206 A5 | 3/1980 |
| CN | 104 295 347 A | 1/2015 |

(Continued)

*Primary Examiner* — Jeremy Luks
(74) *Attorney, Agent, or Firm* — McGlew and Tuttle, P.C.

(57) ABSTRACT

A connection pipe (7), for the fluidic connection of a muffler housing (5) of an active muffler (4) with an exhaust gas-carrying pipe (3) of an exhaust line (2) of an exhaust system (1) for an internal combustion engine, of a motor vehicle, has a pipe wall (8), which envelopes a connection space (9) leading from the muffler housing to the exhaust pipe. A cooling pipe (14), through which a coolant can flow, has an inlet section (15) and an outlet section (16) and is arranged in the connection space. The inlet section (15) passes through the pipe wall (8), whereby a coolant inlet (17), through which coolant can enter the cooling air pipe, is arranged outside the connection pipe (7). The outlet section passes through the pipe wall, whereby a coolant outlet (19), through which coolant can escape from the cooling pipe, is arranged outside the connection pipe (7).

16 Claims, 6 Drawing Sheets

(56) References Cited

U.S. PATENT DOCUMENTS

| | | | | |
|---|---|---|---|---|
| 8,708,095 | B2 * | 4/2014 | Neumann | F01N 13/007 181/212 |
| 2011/0000734 | A1 | 1/2011 | Krueger et al. | |
| 2011/0278090 | A1 * | 11/2011 | Wirth | B60K 13/04 181/228 |

FOREIGN PATENT DOCUMENTS

| | | | |
|---|---|---|---|
| DE | 103 01 438 | A1 | 7/2004 |
| DE | 10 2009 031848 | A1 | 1/2011 |
| DE | 10 2011 089 774 | A1 | 6/2013 |

* cited by examiner

CONNECTION PIPE FOR CONNECTING AN ACTIVE MUFFLER TO AN EXHAUST SYSTEM FOR AN INTERNAL COMBUSTION ENGINE

CROSS REFERENCE TO RELATED APPLICATIONS

This application claims the benefit of priority under 35 U.S.C. § 119 of German Application 10 2015 217 461.1 filed Sep. 11, 2015, the entire contents of which are incorporated herein by reference.

FIELD OF THE INVENTION

The present invention pertains to a connection pipe for connecting an active muffler to an exhaust pipe of an exhaust system for an internal combustion engine, especially of a motor vehicle, wherein the connection pipe has a pipe wall, which envelops a connection space leading from the muffler housing to the exhaust pipe. The present invention pertains, further, to an active muffler, which is connected with such a connection pipe to an exhaust pipe of an exhaust system. Finally, the present invention also pertains to an exhaust system with an active muffler, which is connected with such a connection pipe to an exhaust pipe of the exhaust system.

BACKGROUND OF THE INVENTION

An exhaust system, which has an exhaust line, which has an exhaust gas-carrying exhaust pipe, is known from DE 10 2011 089 774 A1. Further, an active muffler is provided, which has a muffler housing and an electroacoustic converter arranged in the muffler housing. Finally, a connection pipe is provided, whose pipe wall envelops a connection space leading from the muffler housing to the exhaust system and which is fluidically connected to the muffler housing as well as to the exhaust system. The converter, which is preferably a loudspeaker, is exposed in the housing to a front volume, which is fluidically coupled via the connection pipe with the interior space of the exhaust system. Sound generated by the converter can be introduced in this manner during the operation of the active muffler into the front volume, so that the sound can be introduced by the front volume through the connection pipe into the exhaust system. However, this also means during the operation of the exhaust system that hot exhaust gases can enter the front volume and hence the converter from the exhaust system through the connection pipe. As a result, the converter is exposed to a comparatively high thermal load.

To reduce the thermal load of the converter and of the entire active muffler, diaphragm elements may be arranged in the connection pipe in the exhaust system known from the above-mentioned DE 10 2011 089 774 A1 such that the connection pipe remains permeable, on the one hand, for airborne sound, while it becomes opaque in the direction of view extending parallel to the central longitudinal axis of the connection pipe. As a result, heat radiation cannot reach the front volume or the converter directly through the connection pipe from the interior of the exhaust pipe. However, such diaphragm elements arranged in an opaque manner hinder the direct transmission of airborne sound from the front volume of the converter through the connection pipe into the exhaust pipe, as a result of which the acoustic efficiency of the active muffler is reduced. Moreover, a section of the connection pipe, which is equipped with the diaphragm elements, may be designed as a cooling body in order to remove heat in this manner from the exhaust gas in order to reduce the thermal load of the active muffler and especially of the converter.

SUMMARY OF THE INVENTION

An object of the present invention is to provide an improved embodiment or at least another embodiment, which is characterized by an efficient protection of the converter or of the active muffler, for a connection pipe or for an active muffler or for an exhaust system of the type mentioned in the introduction. At the same time, an efficient acoustic coupling is desired between the muffler and the exhaust pipe.

According to the invention, a connection pipe is provided for the fluidic connection of a muffler housing of an active muffler with an exhaust gas-carrying exhaust pipe of an exhaust line of an exhaust system for an internal combustion engine. The connection pipe comprises a connection pipe wall, which envelops a connection space leading from the muffler housing to the exhaust pipe and a cooling pipe, through which a coolant can flow. The cooling pipe has an inlet section and an outlet section, arranged in the connection space. The inlet section passes through the connection pipe wall, with a coolant inlet, through which coolant can enter the cooling air pipe, arranged outside the connection pipe. The outlet section passes through connection pipe wall, with a coolant outlet, through which coolant can escape from the cooling pipe, arranged outside the connection pipe.

According to another aspect of the invention, an active muffler is provided for an exhaust system of an internal combustion engine, especially of a motor vehicle, with a muffler housing, with at least one electroacoustic converter arranged in the muffler housing and with at least one connection pipe in accordance with the invention.

According to another aspect of the invention, an exhaust system is provided for an internal combustion engine, especially of a motor vehicle, with at least one exhaust line, which has at least one exhaust gas-carrying exhaust pipe, and with at least one active muffler in accordance with the invention.

The present invention is based on the general idea of providing at least one cooling pipe, through which a coolant can flow and is arranged such that it passes through the connection pipe. As a result, a section of the cooling pipe is located in the connection space and can bring about cooling in the connection space. By using a cooling pipe, through which a coolant can flow, heat can be transferred from the exhaust gas, which is located in the connection space, to the cooling pipe and from the cooling pipe to the coolant, and the heat can be removed with the coolant from the cooling pipe. This leads to an especially efficient cooling of the exhaust gas in the connection space, as a result of which a corresponding, efficient protection of the converter or of the muffler can be achieved.

An especially efficient cooling can be achieved by a corresponding dimensioning and/or arrangement of the respective cooling pipe as well as by a corresponding number and/or distribution of the cooling pipes in the connection space in case of a plurality of cooling pipes without the sound transmission path being disturbingly compromised in the connection pipe. The exhaust system being presented here thus has an especially high acoustic efficiency.

The respective cooling pipe has an inlet section and an outlet section. The cooling pipe is arranged at or in the connection pipe such that the inlet section passes through the pipe wall, so that a coolant inlet, through which coolant can enter the cooling pipe, is arranged outside the connection pipe, and that the outlet section passes through the pipe wall, so that a coolant outlet, through which coolant can be discharged from the cooling pipe, is arranged outside the connection pipe. No space is needed in this way for feeding and removing the coolant within the connection pipe, so that a comparatively large cross section is available for the propagation of ultrasound in the connection space. The respective passage through the wall is configured so tight that no exhaust gas can escape from the connection space into the surrounding area.

According to an advantageous embodiment, the inlet section and the outlet section of the respective cooling pipe may be passed through the pipe wall on opposite sides of the connection pipe. This leads to an especially simple geometry, which can easily be manufactured. In case of a corresponding embodiment of the tight passage of the inlet section and outlet section through the pipe wall, a fixation may, in particular, also be brought about between the cooling pipe and the pipe wall, so that the connection pipe is significantly braced by the cooling pipe in this embodiment. Due to the rigid connection of the cooling pipe in the inlet section and in the outlet section to the connection pipe, the cooling pipe acts as a hollow anchor that can be stressed with forces of pressure and tensile forces. The passage is sealed, for example, with a soldered or welded or bonded connection.

In a variant, the coolant inlet and the coolant outlet of the respective cooling pipe may be open to an area enveloping the connection pipe, so that ambient air can flow as coolant through the cooling pipe. Ambient air can thus enter the cooling pipe from the surrounding area through the coolant inlet and escape from the cooling pipe into the surrounding area through the coolant outlet. This leads to an especially low-cost embodiment for the cooling.

According to an especially advantageous variant, the respective cooling pipe may be arranged relative to the connection pipe such that the development of a convective flow through the cooling pipe is facilitated in the installed state of the exhaust system and during the operation of the internal combustion engine. When the hot exhaust gas transfers heat from the cooling pipe to the air arranged in the cooling pipe, the air can expand in the cooling pipe. An air flow can develop due to convection in the respective cooling pipe. The arrangement of the cooling pipe at or in the connection pipe facilitates this convection, so that the air heated by the exhaust gas escapes from the cooling pipe through the coolant outlet. At the same time, more air flows from the surrounding area through the coolant inlet into the cooling pipe. Improved, low-cost cooling can be achieved due to this passive, convection-based flow through the respective cooling pipe.

In another embodiment, the coolant outlet may be located on a top side of the connection pipe, while the coolant inlet is located on an underside of the cooling pipe. The top side of the cooling pipe is arranged above the underside of the cooling pipe in relation to the direction of gravity in the installed state of the exhaust system. The convective flow through the cooling pipe is facilitated by this orientation or alignment of the cooling pipe.

In another advantageous variant, the cooling pipe may be arranged relative to the connection pipe and/or formed such that the coolant inlet faces an ambient air flow, which becomes established in the area of the connection pipe when the connection pipe or the muffler or the exhaust system is used in a motor vehicle and with the vehicle moving due to the motion of the vehicle. In addition or as an alternative, this ambient air flow may be generated or intensified by means of a blower arranged in the surrounding area. Since the coolant inlet faces this ambient air flow, this leads at the coolant inlet to an increased pressure, which drives the ambient air into the cooling pipe and generates a cooling air flow from the coolant inlet to the coolant outlet in the cooling pipe.

In another variant, the inlet section of the cooling pipe may be bent at least outside the connection pipe such that the coolant inlet faces the ambient air flow. As a result, the cooling pipe is geometrically adapted in the area of the inlet section to the installation situation in order to improve the incoming flow of ambient air to the coolant inlet.

In addition or as an alternative, the coolant inlet may be beveled against a central longitudinal axis of the cooling pipe such that an inlet cross section of the coolant inlet, which cross section faces the ambient air flow, is larger than a pipe cross section of the cooling pipe adjacent to the beveled coolant inlet. The pipe section is determined at right angles to the central longitudinal axis of the cooling pipe. Due to the increased inlet cross section, the dynamic pressure can be increased at the coolant inlet because of the incoming ambient air flow. Consequently, the velocity of flow at which the air flows through the cooling pipe can be increased.

In addition or as an alternative, the cooling pipe may be made straight at least in the connection space and arranged obliquely in relation to the connection pipe, so that the coolant inlet faces the ambient air flow. As a result, the open cross section of the coolant inlet is increased in the projection parallel to the direction of flow of the ambient air flow, which increases the dynamic pressure at the coolant inlet and improves the flow of cooling air or ambient air through the cooling pipe.

In another embodiment, at least one such cooling pipe may be integrated in a cooling circuit, in which a coolant circulates. The coolant inlet is connected to a feed branch of the cooling circuit, which feeds the coolant to the cooling pipe, while the coolant outlet is connected to a return branch of the cooling circuit, which removes the coolant from the cooling pipe. The cooling circuit may be an open cooling circuit here. However, a closed cooling circuit is preferably used. It may be a cooling circuit that is present at the internal combustion engine or in the vehicle anyway and into which the respective cooling pipe is integrated in a corresponding manner. For example, it may be an engine cooling circuit. It is likewise conceivable to use a cooling circuit or refrigerating circuit of an air conditioner of the vehicle. It is also conceivable as an alternative to this to provide a separate cooling circuit for the cooling of the active muffler. Especially a liquid coolant may be used in such a closed cooling circuit, which considerably increases the efficiency of the heat transfer and hence the cooling effect.

At least two cooling pipes are advantageously integrated parallel into the cooling circuit, so that the coolant can flow through them in parallel. Further, it is conceivable that at least two cooling pipes are integrated in series in the cooling circuit, so that the cooling agent can flow through them one after another. The possibility of parallel flow makes possible a larger volume flow of coolant. The series connection leads to an increased efficiency. All existing coolant pipes are preferably integrated in the cooling circuit either parallel or in series. An embodiment is likewise conceivable in which flow is possible in parallel through a plurality of cooling pipes, while there is a flow in series through a plurality of cooling pipes. It is conceivable, for example, to have coolant flow through at least two groups of cooling pipes in series, the groups themselves being integrated in the cooling circuit in parallel.

In another embodiment, the coolant inlet of at least one such cooling pipe may be connected to a cooling air blower, which draws in ambient air and delivers it through the respective cooling pipe, the coolant outlet being open in the surrounding area, so that the ambient air escapes again into the surrounding area through the coolant outlet of the respective cooling pipe. This corresponds to an active cooling with an open cooling circuit, in which ambient air is used as the coolant.

At least one such cooling pipe may be designed as a straight cooling pipe at least in the connection space in another advantageous embodiment. Straight cooling pipes can be installed in the connection pipe especially simply and hence at a low cost. In addition or as an alternative, at least one such cooling pipe may have a circular cross section at least in the connection space. Such cooling pipes can be manufactured at an especially low cost and installed in a simple manner.

In another embodiment, at least one such cooling pipe may have an oblong cross section at least in the connection space. The cross section is again oriented at right angles to the central longitudinal axis of the respective cooling pipe. The cooling pipe may have an especially large surface in this design, which likewise facilitates an efficient heat transfer from the exhaust gas to the coolant. To compromise the acoustic coupling between the active muffler and the exhaust pipe as little as possible, the cooling pipe designed with the oblong cross section, which is therefore flat, may be arranged in the connection space such that it is oriented parallel to the central longitudinal axis of the connection pipe in relation to the longitudinal direction of the oblong cross section. It is likewise conceivable to arrange the flat cooling pipe in a sloped manner and especially at right angles to the central longitudinal axis of the connection pipe in the connection space in relation to the longitudinal direction of its oblong cross section. An arrangement of a plurality of such flat cooling pipes in the connection space, such that a more or less opaque coverage of the cross section of the connection pipe is obtained, is also conceivable, namely, in a direction of view extending parallel to the central longitudinal axis of the connection pipe.

Further important features and advantages of the present invention appear from the subclaims, from the drawings and from the corresponding description of the figures on the basis of the drawings.

It is obvious that the above-mentioned features, which will also be explained below, may be applied not only in the particular combination indicated, but also in other combinations or alone, without going beyond the scope of the present invention.

Preferred exemplary embodiments of the present invention are shown in the drawings and will be explained in more detail in the following description, where identical reference numbers designate identical or similar or functionally identical components.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
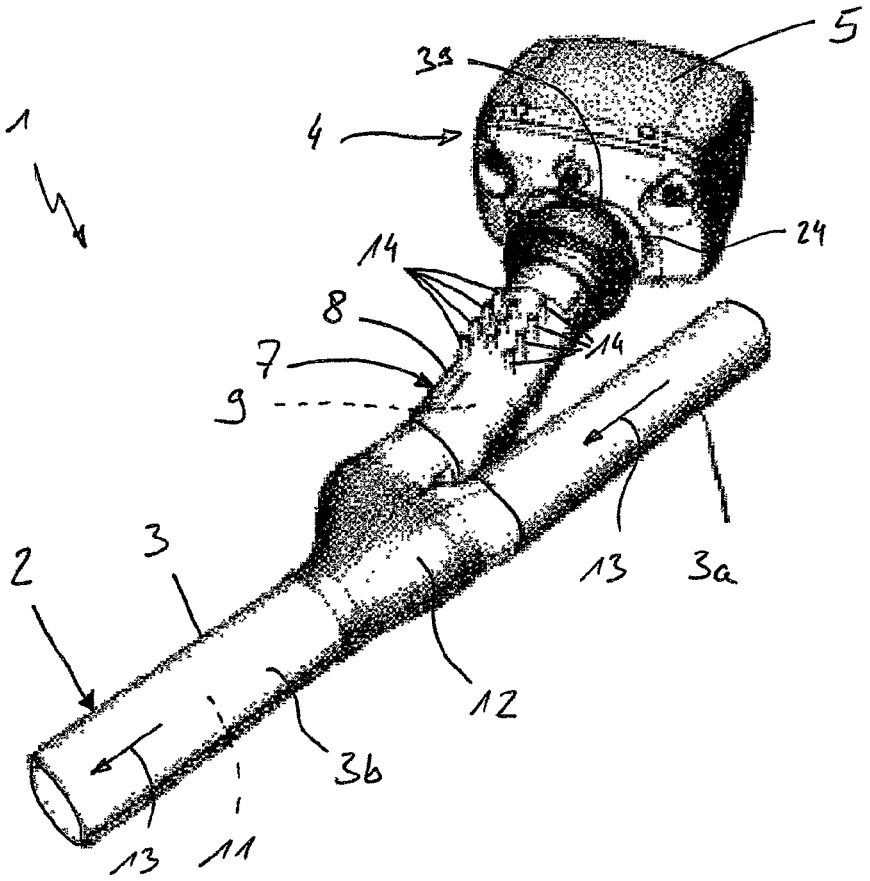
FIG. 1 is a simplified isometric view of an exhaust system in the area of an active muffler.
Figure 2:
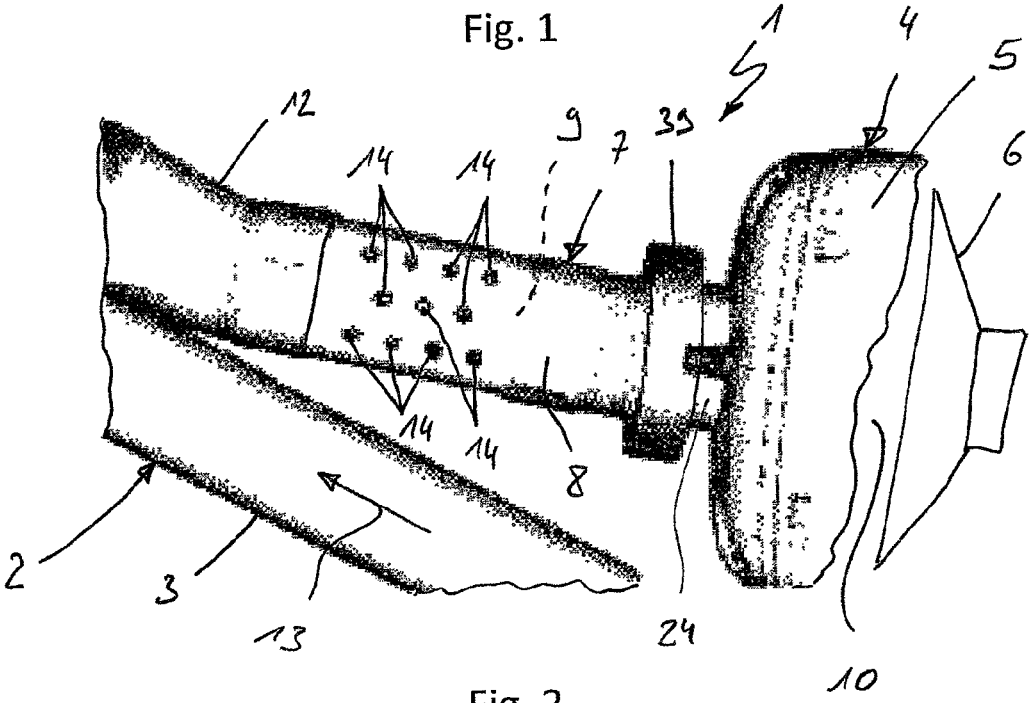
FIG. 2 is a top view of the exhaust system in the area of the active muffler.
Figure 3:
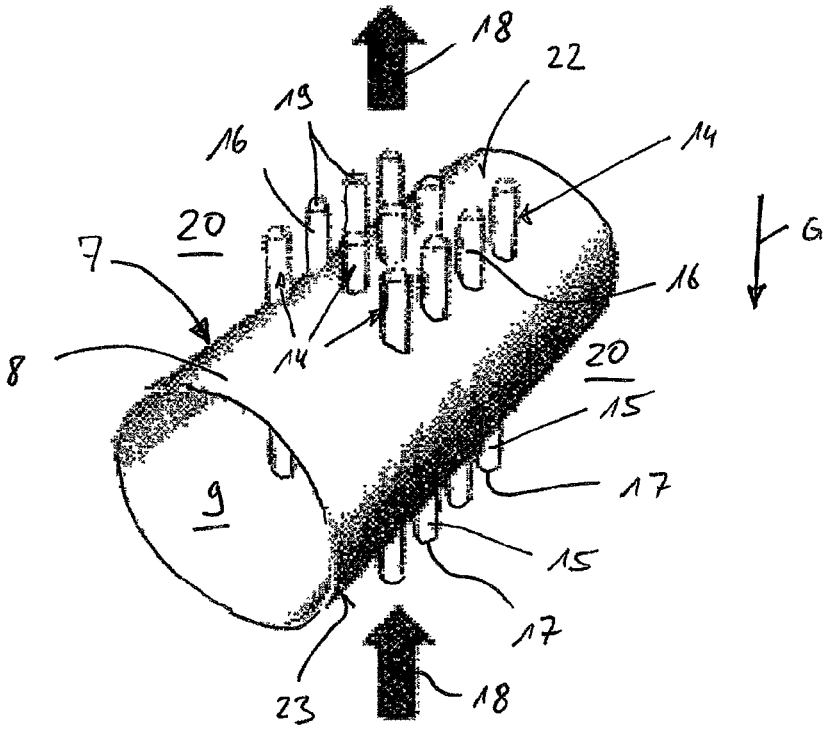
FIG. 3 is a simplified isometric view of a connection pipe of the exhaust system.

Corresponding to FIGS. 1 and 2, an exhaust system 1 for an internal combustion engine (the internal combustion engine is not shown) comprises at least one exhaust line 2, which has at least one exhaust gas-carrying exhaust pipe 3. The exhaust system 1 is used in the usual manner to remove combustion waste gases from the internal combustion engine as well as to treat the exhaust gases in order to reduce sound emissions and pollutant emissions. The internal combustion engine and the exhaust system 1 are preferably arranged in a motor vehicle. The use of the exhaust system being presented here is also conceivable, in principle, in a stationary internal combustion engine. The exhaust line 2 is connected on the inlet side to a cylinder head of the internal combustion engine via an elbow, not shown here. On the outlet side, the exhaust line 2 has a tail pipe, likewise not shown here, through which the exhaust gases can escape into the surrounding area. At least one active muffler 4, by means of which the disturbing noise being transported in the exhaust gas can be changed, is connected to the exhaust line 2 or to the exhaust pipe 3 between the exhaust elbow and the tail pipe. The active muffler 4 usually generates phase-shifted active noise, so-called "active noise control" in order to specifically reduce the disturbing noise. In addition or as an alternative, the active muffler 4 may also be used to modulate the sound being transported in the exhaust line 2 in order to generate a more pleasant sound. A reduction of the loudness of the emitted sound is not absolutely necessary for this. The muffler 4 is thus used to reduce disturbing noise by superimposing synthetically generated sound to it, which leads to a reduction of the loudness and/or to a change in the emitted sound.

The muffler 4 has a muffler housing 5, in which at least one electroacoustic converter 6, indicated schematically in FIG. 2, e.g. in the form of a loudspeaker, by means of which the above-mentioned, schematically indicated synthetic sound can be generated, is arranged in the usual manner. A connection pipe 7, whose pipe wall 8 envelopes a connection space 9, is provided for the acoustic and fluidic coupling of the muffler housing 5 with the exhaust pipe 3. The connection space 9 connects a front volume 10 arranged in the muffler housing 5, to which sound is admitted from the converter 6 during the operation of the muffler 4, with an interior space 11 of the exhaust pipe 3, in which the exhaust gas is flowing during the operation of the internal combustion engine. The connection pipe 7 or its pipe wall 8 thus connects the muffler housing 5 to the exhaust pipe 3 in a gastight manner. The connection preferably also leads to a mechanical fixation of the connection pipe 7 at the exhaust pipe 3 and at the muffler housing 5, so that the muffler housing 5 is ultimately also fixed mechanically at the exhaust pipe 3 by means of the connection pipe 7. The exhaust line 2 may have for this a connection piece 12 in the exhaust pipe 3, which connection piece is configured as a Y-piece in the example shown in FIG. 1. It is essential in the example being shown that a section of the exhaust pipe 3, namely, a pipe section 3*a* located upstream and a pipe section 3*b* located downstream, are present here on both sides of the point at which the muffler 4 is connected to the exhaust pipe 3, i.e., here on both sides of the connection piece 12, in the embodiment being shown here, the direction of flow relating to the exhaust gas flow, which becomes established in the exhaust pipe 3 during the operation of the internal combustion engine, and which is indicated by arrows 13 in the figures. Further, the muffler housing 5 has a connection piece 24 here for connecting the connection pipe 7. The connection may be embodied, for example, by means of a welded and/or clamp connection 39.

Such an active muffler 4 is preferably used as far behind as possible, i.e., at a distance from the engine, in order to make it possible to affect the disturbing noise before it escapes into the surrounding area from the exhaust line 2 through the respective tail pipe. In a position remote from the engine, the disturbing noise is already muffled substantially by the exhaust system, especially by conventional passive mufflers, so that the efficiency of the active muffler 4 is especially high at this point. In particular, the discharge-side pipe section 3*b* shown in FIG. 1 may form the tail pipe. However, any desired positioning is conceivable, in principle, along the exhaust line 2. In particular, arrangement close to the engine is also conceivable.

The exhaust gas carries heat with it, which can propagate from the interior space 11 of the exhaust pipe 3 through the connection space 9 up into the front volume 10 of the muffler 4 and may lead to a corresponding increase in the temperature of the converter 6 there. The closer the muffler 4 is arranged to the engine, the higher is the thermal load of the muffler 4 or of the corresponding converter 6. To reduce this thermal load, the exhaust system 1 being shown here or the muffle 4 being shown here or the connection pipe 7 being shown here has at least one cooling pipe 14, through which a coolant can flow and which is arranged at least partially in the connection space 9. A plurality of such cooling pipes 14 are preferably provided, which preferably have the same design or at least a similar design. A plurality of different embodiments for these cooling pipes 14, which may preferably be embodied alternatively, will be presented below. In principle, two or more variants or all variants may also be embodied in a cumulated form, such that at least two cooling pipes 14 have different designs within the same connection pipe 7.

As can be determined especially from FIGS. 3 through 14, the respective cooling pipe 14 has an inlet section 15 and an outlet section 16. The inlet section 15 passes through the pipe wall 8, so that a coolant inlet 17 of the respective cooling pipe 14 is located outside the connection pipe 7. A coolant flow indicated by arrows 18 in the figures can enter the respective cooling pipe 14 through the coolant inlet 17. The outlet section 16 likewise passes through the pipe wall 8, so that a coolant outlet 19 is also arranged outside the connection pipe 7. The coolant is discharged again from the cooling pipe 14 through the coolant outlet 19. The individual pipe passages are made sufficiently tight in a suitable manner. For example, passages, through which the cooling pipes 14 are passed, may be formed in the pipe wall 8. An outwardly projecting ring collar of the respective passage comes obliquely into contact with the outer circumference of the respective cooling pipe 14, so that a sufficiently tight connection can be obtained especially in combination with a soldered connection or welded connection.

Figure 12:
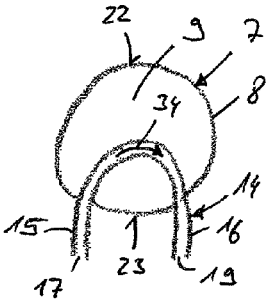
FIG. 12 is a highly simplified cross section of the connection pipe in another of different embodiments.
Figure 13:
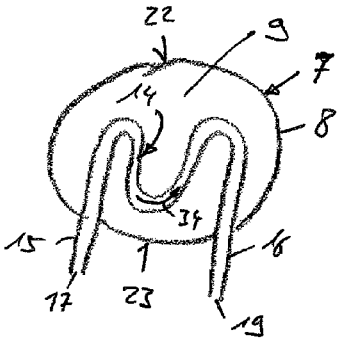
FIG. 13 is a highly simplified cross section of the connection pipe in another of different embodiments.

In the embodiments being shown here, the inlet section 15 and the outlet section 16 are passed through the pipe wall 8 on opposite sides (22, 23) of the connection pipe 7 in all cooling pipes 14. As a result, the cooling pipes 14 can be installed especially simply in the connection pipe 7, especially in case of a preferred straight design. It is indicated in FIGS. 12 and 13 only that it is also possible to arrange the inlet section 15 and the outlet section 16 differently, so that they pass through the pipe wall 8 on the same side (23) of the connection pipe 7. Such configurations are suitable rather for embodiments described below, which operate with active cooling.

Figure 4:
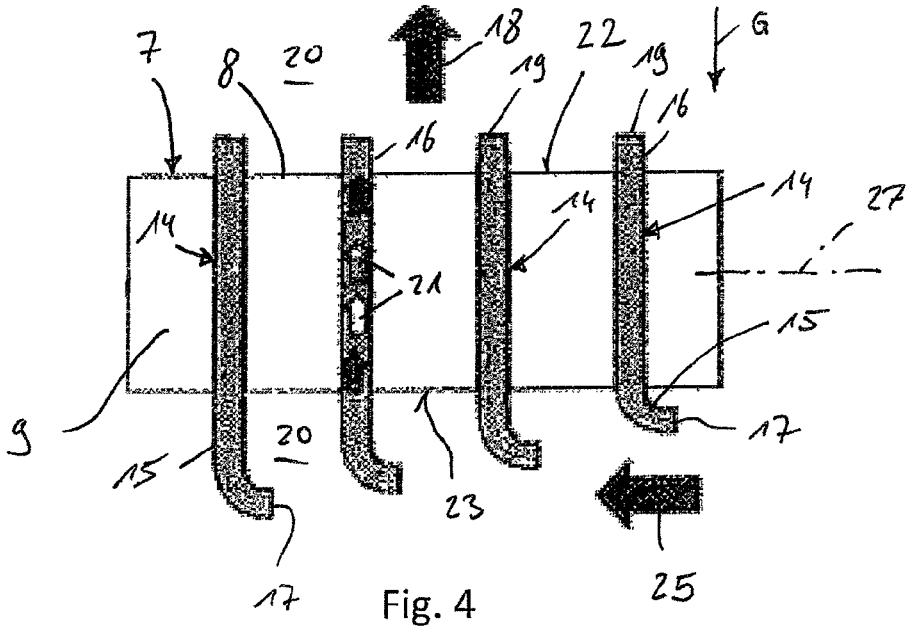
FIG. 4 is a highly simplified schematic diagram in the area of a longitudinal section of the connection pipe showing one of different embodiments.

The coolant inlet 17 and the coolant outlet 19 of the respective cooling pipe 14 are open to a surrounding area 20 enveloping the connection pipe 7 in the embodiments shown in FIGS. 1 through 6. As a consequence, ambient air can flow as a coolant through the respective cooling pipe 14. This coolant flow or air flow through the cooling pipes 14 may take place purely passively by convection. The cooling pipes 14 may preferably be arranged for this relative to the connection pipe 7 such that the development of a convective flow, which is indicated by arrows 21 in FIG. 4, is facilitated through the respective cooling pipe 14 in the installed state of the exhaust system 1 and during the operation of the internal combustion engine. Especially advantageous here is an embodiment in which the coolant outlet 19 is located on the top side 22 of the connection pipe 7, while the coolant inlet 17 is located on an underside 23 of the connection pipe 7. The top side 22 is located in the installed state of the exhaust system 1 above the underside 23 in relation to the direction of gravity G indicated by an arrow. The top side 22 and the underside 23 thus preferably form the above-mentioned two opposite sides of the connection pipe 7, through which the respective inlet section 15 and the respective outlet section 16 are passed. During the operation of the exhaust system 1, the exhaust gas, which can enter the connection pipe 7 from the exhaust pipe 3, heats the respective cooling pipe 14, which is exposed to the exhaust gas in the connection space 9. The heat absorbed by the cooling pipe 14 is transmitted to the air located therein, so that this is heated and can rise. The heated air thus escapes the cooling pipes 14 on the top side 22, and cooler air is drawn in at the same time from the surrounding area 20 on the underside 23.

Figure 5:
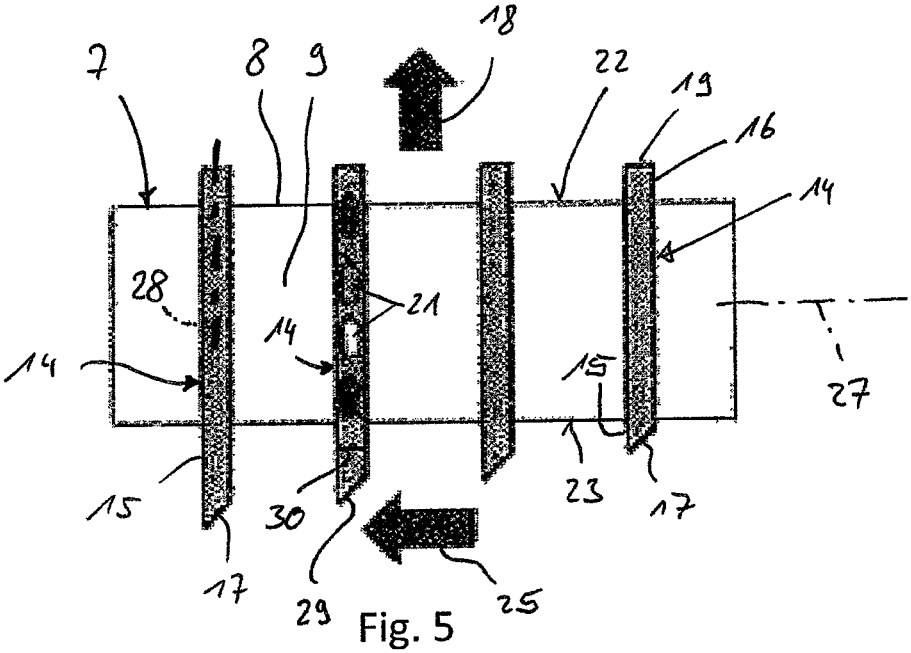
FIG. 5 is a highly simplified schematic diagram in the area of a longitudinal section of the connection pipe showing another of different embodiments.
Figure 6:
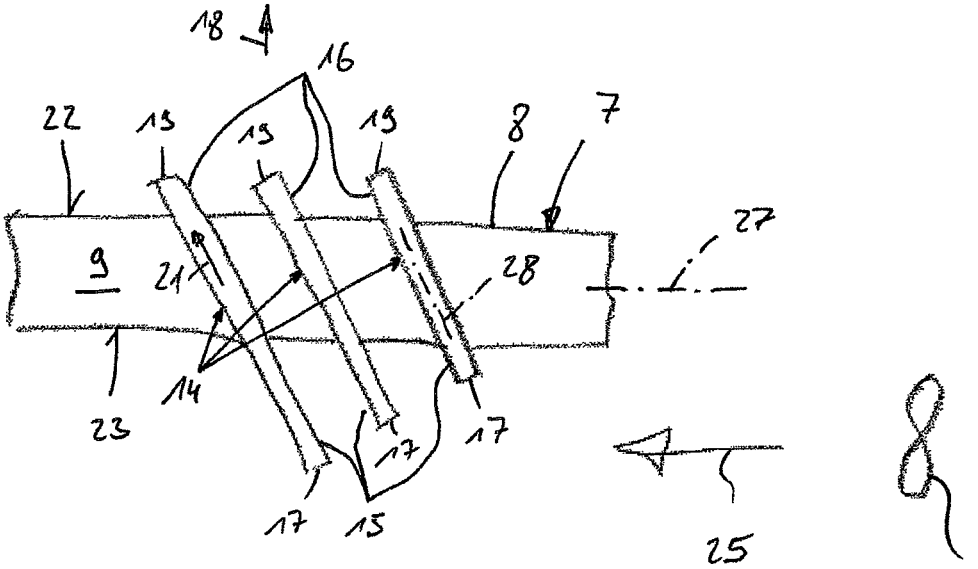
FIG. 6 is a highly simplified schematic diagram in the area of a longitudinal section of the connection pipe showing another of different embodiments.
Figure 7:
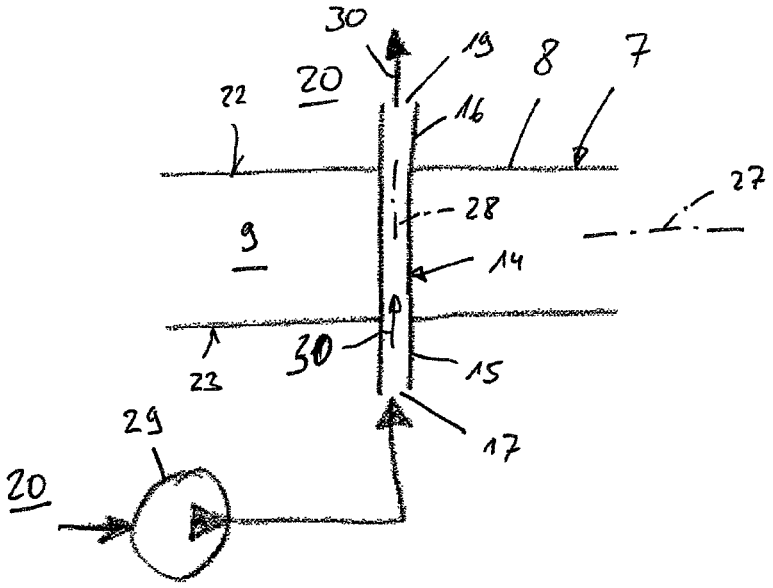
FIG. 7 is a highly simplified schematic diagram in the area of a longitudinal section of the connection pipe showing another of different embodiments.

To improve this convective flow 21, the respective cooling pipe 14 may be arranged and/or shaped relative to the connection pipe 7 such that the coolant inlet 17 faces an ambient air flow 25, which is indicated by an arrow each in FIGS. 4 through 6. This ambient air flow 25 may be set in the area of the connection pipe 7, for example, due to the motion of the vehicle if the exhaust system 1 is used in a vehicle. The ambient air flow 25 is formed especially by a part of the so-called "slip stream." In addition or as an alternative, a blower 26 indicated in FIG. 6 may also be provided, which is arranged for this in the surrounding area 20 and which generates or intensifies the ambient air flow 25. Such a blower 26 may optionally be provided in other embodiments as well.

According to the example shown in FIG. 4, the inlet section 15 of the respective cooling pipe 14 may be bent outside the connection pipe 7 such that the coolant inlet 17 faces the ambient air flow 25. In the example shown in FIG. 4, the ambient air flow 25 flows essentially parallel to a central longitudinal axis 27 of the connection pipe 7. The cooling pipe 14 extends within the connection pipe 9 at right angles to the central longitudinal axis 27. As a consequence, the inlet sections 15 are bent by about 90° to arrange the coolant inlets 17 at different radial distances increasing in a downstream direction of the ambient air flow, so that the coolant inlet 17 is optimally directed towards the ambient air flow 25.

No such bending deformation of the cooling pipes 14 is used in the area of the inlet section 15 in the embodiment shown in FIG. 5. By contrast, the coolant inlet 15 is beveled in relation to the central longitudinal axis 28 of the respective cooling pipe 14. As a result, the coolant outlet 17 is no longer oriented parallel to the central longitudinal axis 28 but is sloped in relation to it. As a result, an inlet cross section 29 of the respective coolant inlet 17 is larger than a pipe cross section 30 of the cooling pipe 14, which the cooling pipe 14 has over the rest of its course, but at least within the connection space 9. The coolant inlet 17 is beveled such that the enlarged inlet cross section 29 faces the ambient air flow 25.

In the embodiment shown in FIG. 6, the convective flow 21 is supported by an oblique arrangement of the cooling pipes 14 in the connection pipe 7. The cooling pipes 14, which are straight preferably at least in the connection space 9, are arranged obliquely in relation to the connection pipe 7, and the orientation is such here as well that the respective coolant inlet 17 faces the ambient air flow 25. The central longitudinal axes 28 of the coolant pipes 14 form for this an angle that is smaller than 90° with the central longitudinal axis 27 of the connection pipe 7.

Even though the embodiments shown in FIGS. 4 through 6 were explained alternatively, it is clear that these different embodiments may also be used in a combination. Thus, provisions may be made for the cooling pipes 14 to be arranged obliquely in the connection pipe 7 and/or to be provided with a beveled coolant inlet 17 and/or with a bent inlet section 15.

While the cooling operates largely passively in the embodiments shown in FIGS. 1 through 5, examples of an active cooling are shown in FIGS. 7 through 10. According to FIG. 7, the coolant inlet 17 in the respective cooling pipe 14 may be connected to a cooling air blower 29 and connected to the surrounding area 20 on the suction side and to the coolant inlet 17 on the delivery side. The cooling air blower 29 thus draws ambient air as a coolant from basically any desired and suitable, especially cool place and delivers this through the respective cooling pipe 14. A corresponding cooling air flow is indicated by arrows 30. The cooling air flow 30 is again discharged into the surrounding area 20 through the coolant outlet 19 of the respective cooling pipe 14. Consequently, an open cooling circuit, which operates with ambient air as a coolant, is embodied in FIG. 7.

Figure 8:
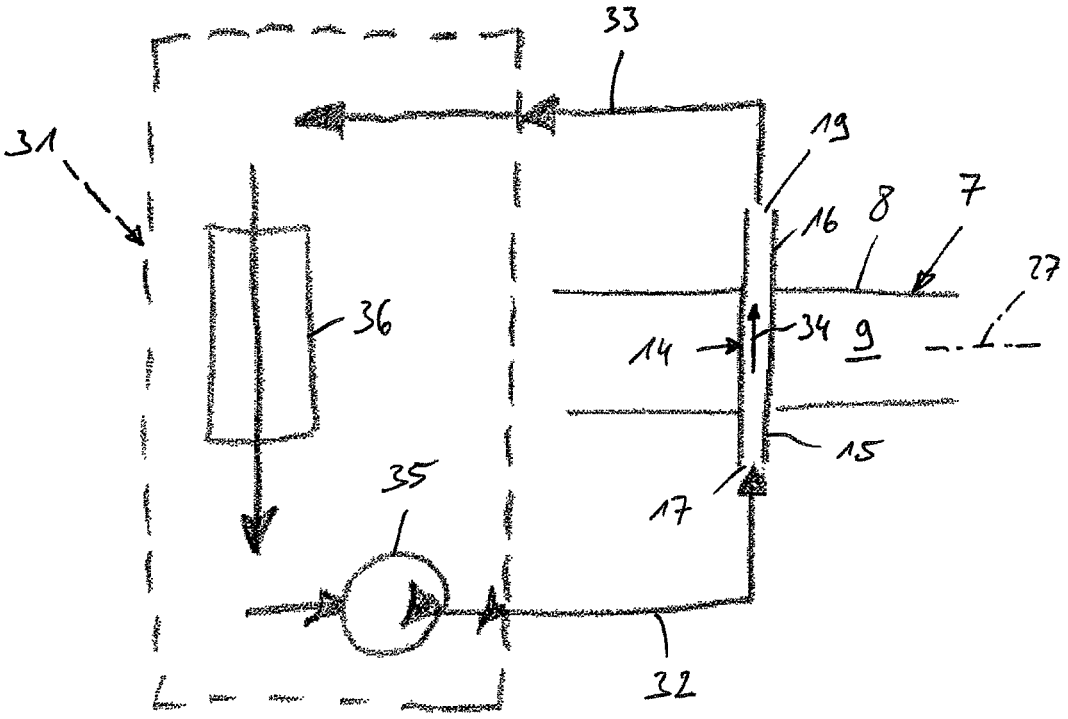
FIG. 8 is a highly simplified schematic diagram in the area of a longitudinal section of the connection pipe showing another of different embodiments.
Figure 9:
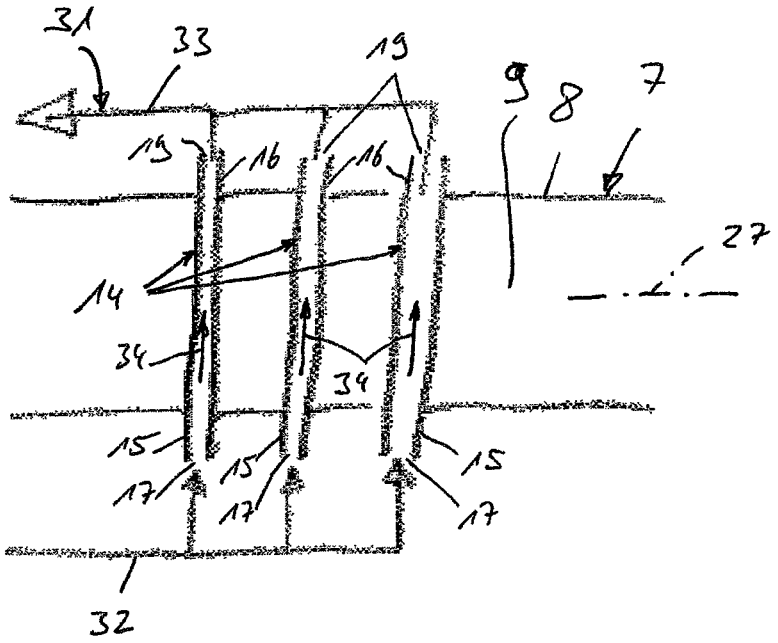
FIG. 9 is a highly simplified schematic diagram in the area of a longitudinal section of the connection pipe showing another of different embodiments.
Figure 10:
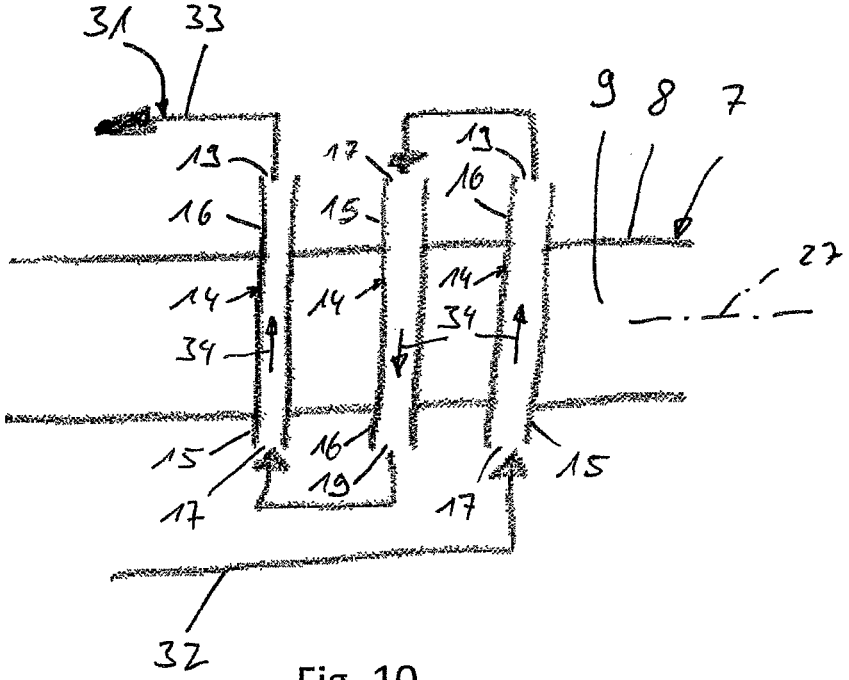
FIG. 10 is a highly simplified schematic diagram in the area of a longitudinal section of the connection pipe showing another of different embodiments.
Figure 11:
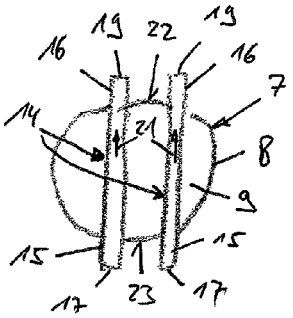
FIG. 11 is a highly simplified cross section of the connection pipe in one of different embodiments.

Contrary to this, FIGS. 8 through 10 show examples of a closed cooling circuit 31, into which the respective cooling pipe 14 is integrated. The coolant inlet 17 is connected for this to a feed branch 32 of the cooling circuit 31, while the coolant outlet 19 is connected to a return branch 33 of the cooling circuit 31. The respective coolant is fed during the operation of the cooling circuit 31 via the feed branch 32 to the respective cooling pipe 14 and removed therefrom via the return branch 33. As a result, a coolant flow, which is indicated by an arrow 34, develops in the cooling pipe 14, A liquid coolant preferably circulates in the cooling circuit 31. The cooling circuit 31 is, for example, a branch of an engine cooling circuit, which is used to cool the internal combustion engine. The cooling circuit 31 has a coolant pump for this for driving the coolant as well as a heat exchanger 36, via which the absorbed heat can be released from the coolant to the surrounding area.

The cooling pipes 14 may be integrated in the cooling circuit 31 according to FIG. 9 such that a plurality of cooling pipes 14 are integrated parallel into the cooling circuit 31, so that the coolant flows parallel through these cooling pipes 14. As an alternative, provisions may be made according to FIG. 10 for integrating a plurality of cooling pipes 14 in series in the cooling circuit 31, so that the coolant flows through them one after another. It is clear that a combination is conceivable in this case as well. For example, a plurality of cooling pipes 14 may be arranged one after another and next to one another in relation to the central longitudinal axis 27 of the connection pipe 7 at the cooling pipe according to the examples shown in FIGS. 14 through 17, and at least two rows or groups 37 of cooling pipes 14 arranged next to each other are formed, in which a plurality of cooling pipes 14 arranged one after another are contained. The individual cooling pipe groups 37 may now preferably be connected parallel to the cooling circuit 31, so that the coolant flows parallel through these cooling pipe groups 37. The corresponding cooling pipes 14 may be connected in series to the cooling circuit 31 within the respective cooling pipe group 37, so that the coolant flows through them one after another within the cooling pipe group 37.

Figure 14:
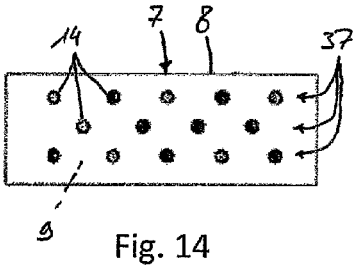
FIG. 14 is a highly simplified top view of the connection pipe in one of different embodiments.
Figure 15:
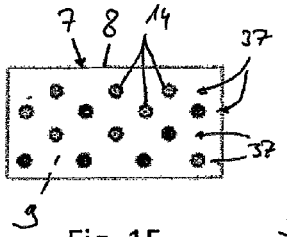
FIG. 15 is a highly simplified top view of the connection pipe in another of different embodiments.
Figure 16:
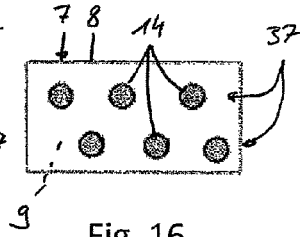
FIG. 16 is a highly simplified top view of the connection pipe in another of different embodiments.
Figure 17:
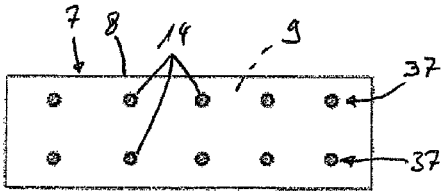
FIG. 17 is a highly simplified top view of the connection pipe in another of different embodiments.

Purely as an example, two cooling pipe groups 37 are indicated in the variants according to FIGS. 16 and 17, while the example according to FIG. 14 shows three cooling pipe groups 37 and the example according to FIG. 15 shows four cooling pipe groups 37.

Figure 18:
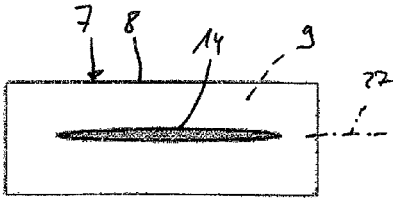
FIG. 18 is a highly simplified top view of the connection pipe in another of different embodiments.
Figure 19:
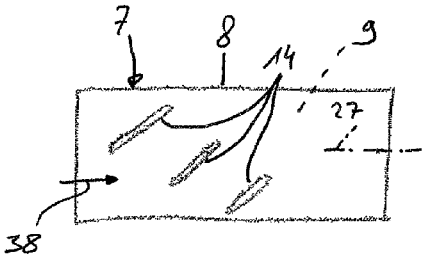
FIG. 19 is a highly simplified top view of the connection pipe in another of different embodiments.
Figure 20:
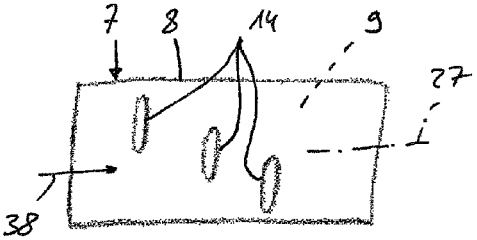
FIG. 20 is a highly simplified top view of the connection pipe in another of different embodiments.

The cooling pipes 14 preferably have a circular cross section each, which is indicated in the examples according to FIGS. 14 through 17. Contrary to this, FIGS. 18 through 20 show examples of cooling pipes 14 that have an oblong, especially straight cross section at least in the connection space 9. As a result, the respective cooling pipe 14 will have a flat profile, whose longitudinal direction is defined by the larger dimension of the oblong cross section. In the example according to FIG. 18, the flat cooling pipe 14 is oriented parallel to the central longitudinal axis 27 of the connection pipe 7 in relation to its longitudinal direction. By contrast, the respective cooling pipe 14 is set at an angle relative to the central longitudinal axis 27 of the connection pipe 7 in its longitudinal direction in the examples shown in FIGS. 19 and 20. There is an angle of about 45° in the example according to FIG. 19. There is an angle of about 90° in the example according to FIG. 20. Furthermore, the arrangement of the flat cooling pipes 14 is selected in the embodiments according to FIGS. 19 and 20 such that there will be a large coverage for the cross section of the connection pipe 7 in a direction of view 38 that extends parallel to the central longitudinal axis 27 of the connection pipe.

The connection pipe 7 has a straight shape in the embodiments being shown here, which simplifies its manufacture.

While specific embodiments of the invention have been shown and described in detail to illustrate the application of the principles of the invention, it will be understood that the invention may be embodied otherwise without departing from such principles.

What is claimed is:

1. A connection pipe for the fluidic connection of a muffler housing of an active muffler with an exhaust gas-carrying exhaust pipe of an exhaust line of an exhaust system for an internal combustion engine, the connection pipe comprising:

a connection pipe wall, which envelops a connection space leading from the muffler housing to the exhaust pipe; and a cooling pipe, through which a coolant can flow and which has an inlet section and an outlet section, arranged in the connection space, wherein:

the inlet section passes through the connection pipe wall, with a coolant inlet, through which coolant can enter the cooling air pipe, arranged outside the connection pipe, the inlet section of the cooling pipe includes a bend arranged outside of the connection pipe wall such that the coolant inlet faces an ambient air flow; and the outlet section passes through connection pipe wall, with a coolant outlet, through which coolant can escape from the cooling pipe, arranged outside the connection pipe wherein: the bend in the inlet section arranges an axial direction of the inlet section between the bend and the coolant inlet to face the ambient air flow, and further comprising: a plurality of cooling pipes similar to the cooling pipe, the bend of each of the plurality of cooling pipes being arranged at a different radial distance from the connection pipe wall.

2. A connection pipe in accordance with claim 1, wherein the inlet section and the outlet section of the cooling pipe pass through the connection pipe wall on opposite sides of the connection pipe.

3. A connection pipe in accordance with claim 2, wherein the coolant inlet and the coolant outlet are open toward a surrounding area enveloping the connection pipe, whereby ambient air can flow as a coolant through the cooling pipe.

4. A connection pipe in accordance with claim 3, wherein the cooling pipe is arranged relative to the connection pipe such that a development of a convective flow through the cooling pipe is facilitated in an installed state of the connection pipe and of the exhaust system and during the operation of the internal combustion engine.

5. A connection pipe in accordance with claim 3, wherein:

the coolant outlet is located on a top side of the connection pipe;

the coolant inlet is located on an underside of the cooling pipe; and the top side of the cooling pipe is located above the underside of the cooling pipe in relation to the direction of gravity.

6. A connection pipe in accordance with claim 3, wherein the cooling pipe is arranged or shaped or both arranged or shaped in relation to the connection pipe to position the coolant inlet so as to face the ambient air flow, which becomes established in the area of the connection pipe during use in a motor vehicle and with the vehicle moving due to the motion of the vehicle.

7. A connection pipe in accordance with claim 6, wherein the coolant inlet is beveled in relation to a central longitudinal axis of the cooling pipe such that an inlet cross section of the coolant inlet facing the ambient air flow is larger than a pipe cross section of the cooling pipe.

8. A connection pipe in accordance with claim 6, wherein the cooling pipe is straight at least in the connection space and is arranged obliquely relative to the connection pipe, whereby the coolant inlet faces the ambient air flow.

9. A connection pipe in accordance with claim 1, further comprising a cooling air blower wherein the coolant inlet of the cooling pipe is connected to the cooling air blower, which draws in ambient air and delivers same through the respective cooling pipe, wherein the ambient air escapes again into the surrounding area through the coolant outlet of the respective cooling pipe.

10. A connection pipe in accordance with claim 1, wherein:

the cooling pipe is configured as a straight pipe at least in the connection space; or the cooling pipe has a circular cross section at least in the connection space; and the cooling pipe has an oblong cross section at least in the connection space.

11. A connection pipe in accordance with claim 3, further comprising a blower wherein the cooling pipe is arranged or shaped or both arranged or shaped in relation to the connection pipe to position the coolant inlet so as to face an air flow which becomes established by the blower arranged in the surrounding area.

12. A connection pipe in accordance with claim 1, further comprising:

a plurality of cooling pipes similar to the cooling pipe, each of the plurality of cooling pipes extending diametrically across the connection space with substantially no extension in an axial direction of the connection pipe wall;

the outlet section of the cooling pipes extend radially outward from the connection pipe wall.

13. An active muffler for an exhaust system of an internal combustion engine of a motor vehicle, the active muffler comprising:

a muffler housing;

an electroacoustic converter arranged in the muffler housing; and at least one connection pipe comprising:

a connection pipe wall fluidically connected to the muffler housing and fluidically connected to an exhaust pipe of an exhaust line of the exhaust system; and a plurality of cooling pipes, through which a coolant can flow and which each has an inlet section and an outlet section, arranged in the connection space, wherein in each of the cooling pipes:

the inlet section passes through the connection pipe wall, with a coolant inlet, through which coolant can enter the cooling air pipe, arranged outside the connection pipe, the inlet section of the cooling pipe having a bend outside the connection pipe such that the coolant inlet faces an ambient air flow, each bend being arranged at a different radial distance from the connection pipe wall, the different radial distances increasing in a downstream direction of the ambient air flow; and the outlet section passes through connection pipe wall, with a coolant outlet, through which coolant can escape from the cooling pipe, arranged outside the connection pipe.

14. An exhaust system for an internal combustion engine, the exhaust system comprising:

an exhaust line;

a connection pipe wall defining a connection space fluidically connected to said exhaust line;

a muffler housing fluidically connected to said connection space;

an electroacoustic converter arranged in said muffler housing;

a cooling pipe passing diametrically though said connection space and through opposite sides of said connection pipe wall, said cooling pipe having a coolant inlet and a coolant outlet, both said cooling inlet and outlet being arranged radially outside said connection pipe wall, said cooling pipe defining a passage for coolant from said coolant inlet to said coolant outlet, said coolant inlet and said coolant outlet having openings open to a surrounding environment enveloping said connection pipe wall to flow ambient air as the coolant through said cooling pipe, said cooling pipe including an inlet section extending radially outward from said connection pipe wall, said inlet section having a bend arranging said opening of said coolant inlet to face an ambient air flow wherein: said bend in said inlet section arranges an axial direction of said inlet section between said bend and said opening to face the ambient air flow, and further comprising: a plurality of cooling pipes similar to said cooling pipe, said bend of each of said plurality of cooling pipes being arranged at a different radial distance from said connection pipe wall.

15. An exhaust system in accordance with claim 14, further comprising:

a plurality of cooling pipes similar to said cooling pipe, each of said plurality of cooling pipes extending diametrically across said connection space with substantially no extension in an axial direction of said connection pipe wall.

16. An exhaust system in accordance with claim 14, wherein:

said cooling pipe includes an outlet section extending radially outward from said connection pipe wall.

* * * * *